US005323517A

United States Patent [19]

Su

[11] Patent Number: 5,323,517

[45] Date of Patent: Jun. 28, 1994

[54] CLAMP FOR FASTENING NIPPLES TO PAPER NURSING BOTTLES

[76] Inventor: Jeng Wann Su, No. 8, Alley2, Lane 91, Chien Min Rd., Taipei, Taiwan

[21] Appl. No.: 96,603

[22] Filed: Jul. 22, 1993

[51] Int. Cl.[5] ..... A44B 21/00

[52] U.S. Cl. ..... 24/517; 24/20 EE

[58] Field of Search ..... 24/517, 301, 306, 498, 24/489, 280, 282, 285, 287, 20 R, 20 EE, 20 S; 403/344; 224/148

[56] References Cited

U.S. PATENT DOCUMENTS

| | | | |
|---|---|---|---|
| 234,799 | 11/1880 | Neely | 24/517 |
| 293,564 | 2/1884 | Collins | 24/517 |
| 637,068 | 11/1899 | Bang | 24/285 |
| 2,113,443 | 4/1938 | Eggerss | 24/20 EE |
| 2,640,524 | 6/1953 | Carpenter | 24/20 EE |
| 3,330,354 | 7/1967 | Chamblee | 24/517 |
| 3,543,976 | 12/1970 | Ronald | 224/148 |

*Primary Examiner*—Victor N. Sakran

*Attorney, Agent, or Firm*—McCubbrey, Bartels & Ward

[57] ABSTRACT

A clamp includes a first half and a second half, which are pivotally connected semi-cylindrical halves, said semi-cylindrical halves each having a first end and a second end, each of the second ends defining a ridge; and a jaw for engaging with said two ridges for assembling the first half and the second half into a cylindrical form, said jaw has a first distal end slidably linking to the second end of the first semi-cylindrical half and a second end for engaging with the ridge of the second end of the second semi-cylindrical half.

7 Claims, 2 Drawing Sheets

CLAMP FOR FASTENING NIPPLES TO PAPER NURSING BOTTLES

BACKGROUND OF THE INVENTION

The present invention relates to a clamp for fastening nipples to paper nursing bottles.

Most babies or young children are fed with edible fluids or suspensions, such as milk prepared by suspending commercial milk powder, by means of conventional nursing bottles made from plastic or glass, which are even useful for those preferring to feed maternal milk. Generally, each baby or young child needs several nursing bottles for desired fluids, such as milk, water, juices, nutrients supplemented flours and the suspension of medicines. Every time conventional nursing bottles have been used for feeding babies or young children, they should be subjected to a series of processes before reuse:washing, sterilizing or boiling and drying. Therefore, the multiplicity of the conventional nursing bottles causes inconvenience and additional burdens on parents. The increase in numbers of available nursing bottles makes such troubles manifest when the parents go out with their babies or young children, as it is difficult to treat used conventional nursing bottles. Accordingly, conventional nursing bottles are replaced gradually by fashionable paper nursing bottles fabricated from paper, hereinafter referred to as paper nursing bottle.

Each paper nursing bottle has an opening. Firstly, a nipple is mounted on an annular rigid neck. Then, the annular rigid neck is inserted into the paper nursing bottle. After this, a clamp is provided about the paper nursing bottle. Accordingly, the paper nursing bottle is firmly pressed against the annular rigid neck by means of the clamp.

A typical clamp for fastening the neck to the paper nursing bottle, for example, is a ring which generally has two pivotally connected half rings. Each half ring has a free end with a buckle portion formed thereon. When a user intends to engage the free ends of the half rings for fastening the annular rigid neck to the paper nursing bottle, firstly he/she must place an annular rigid neck, on which a nipple is mounted, in the opening of the paper nursing bottle and fix one of the half rings to the paper nursing bottle with one hand, and with the other hand, engage the free ends by overlapping the buckles and then use a belt for coupling the overlapped buckles. Alternatively, the tail of the belt coupling the overlapped buckles may be further fixed by a device of a hook means or a tongue-and-eyelet means.

The paper nursing bottle as described above such overcomes the aforementioned problems concerning the conventional nursing bottle, however, it inherently has at least two disadvantages. First, it requires skill and experience for coupling the belt about the buckles as the belt is separate from the clamp buckles. It is inconvenient for new users or even skilled users to use the conventional clamp in urgent conditions. Second, even skilled users tend to use both hands thereof in handling the conventional clamp means. Frequently, a user may embrace a crying baby or pull a mischievous young child with a hand and use his/her remaining hand for handling the conventional clamp. Therefore, it is very difficult to engage the half rings with each other and further fasten the annular rigid neck to the paper nursing bottle if the user needs to control various conditions simultaneously.

Accordingly, the present invention provides a clamp to avoid and overcome the aforementioned problems.

SUMMARY OF THE INVENTION

The present invention provides a clamp which includes a first semi-cylindrical half pivotally connected to a second semi-cylindrical half for enclosing an annular rigid neck on which a nipple is mounted. The semi-cylindrical halves each have a first end and a second end defining a J-shaped flange form on an upper rim thereof for fasten the annular rigid neck on which a nipple in mounted. At the second ends of each semi-cylindrical half, a ridge extends downwardly from the J-shaped flange. A jaw is used for engaging the ridges with each other for assembling the first half and the second half into a cylindrical form. The first ends of the semi-cylindrical halves of the clamp each further has a knuckle for engaging with each other. In a specific aspect of the present invention, the knuckles each define a hole formed therein. A pin is inserted in the holes formed in the engaging knuckles.

The jaw has a first distal end and a second distal end.

The second end of the first semi-cylindrical half has a relatively longer ridge extending from the underside of the J-shaped flange of the first semi-cylindrical half, while the second end of the second semi-cylindrical half has a relatively shorter ridge extending from the underside of the J-shaped flange of the second semi-cylindrical half. Such device forms two positions of the jaw relative to the ridges. In the first position, the jaw only engages the longer ridge, while in the second position the jaw engages both ridges for assembling the semi-cylindrical halves into a cylindrical form.

The second end of the first semi-cylindrical half also has a guide formed thereon and a limit formed thereon below the longer ridge and the guide. The guide cooperates with the longer ridge so as to define a slot wherein the first distal end of the jaw is slidably mounted. When view vertically the slot has a substantially dovetailed section and the first distal end of the jaw has a slightly smaller but otherwise identical shape to the slot so that the first distal end of the jaw cannot be removed out of the slot. Said limit can prevent the jaw from sliding out of the first semi-cylindrical half.

The second end of the second semi-cylindrical half may have a guide formed thereon and a limit formed thereon below the short ridge and the guide. The guide and limit formed on the second semi-cylindrical half are similar to the guide and limit formed on the first semi-cylindrical half in configuration and function.

Other objects, advantages, and novel features of the invention will become more apparent from the following detailed description when taken in conjunction with the accompanying drawings.

BRIEF DESCRIPTION OF THE INVENTION

DETAILED DESCRIPTION OF THE PREFERRED EMBODIMENTS

Figure 1:
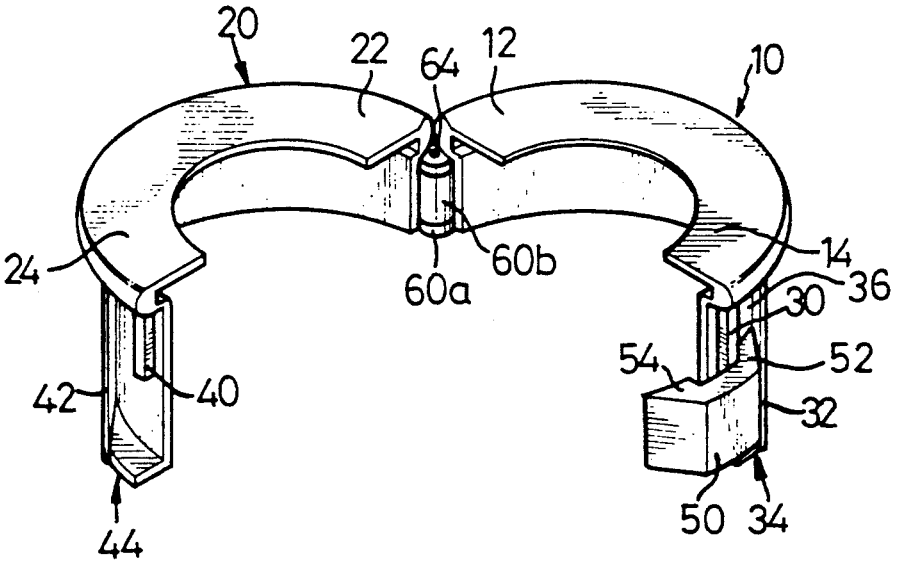
FIG. 1 is a perspective view of a clamp in accordance with the present invention.
Figure 4:
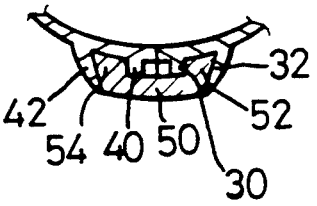
FIG. 4 is a cross-sectional view taken along line 4—4 in FIG. 3, showing the details of the jaw and the ridges in the first position.

Referring to the drawings and initially to FIG. 1, the clamp in accordance with the present invention generally has pivotally connected halves 10 and 20 each having a J-shaped flange formed oh an upper rim thereof. Each J-shaped flange has a short portion extending radially outward from the upper rim of each half and a long portion extending radially inward from the short portion.

The half 10 has a first end 12 and a second end 14. The half 20 has a first end 22 and a second end 24. The first end 12 has a knuckle 60*a* formed thereon. The knuckle 60*a* has a hole formed therethrough. The first end 22 has a knuckle 60*b* formed thereon. The knuckle 60*b* has a hole formed therethrough. The knuckles 60*a* and 60*b* engage with each other and are pivotally connected to each other by means of a pin 64 received in the holes formed therethrough. A ridge 30 is formed on the second end of the half 10. A ridge 40 is formed on the second end of the half 20. The ridge 30 is longer than the ridge 40. A jaw 50 is used in order to engage with the ridges 30 and 40 for assembling the halves 10 and 20 into a cylindrical form. The configuration of the jaw 50 will be later described in detail.

The second end 14 of the first half 10 further has a guide 32 formed thereon and also a limit 34 formed thereon below the ridge 30 and the guide 32. The guide 32, limit 34, the J-shaped flange's short portion and the longer ridge 30 define a slot 36 which is substantially dovetailed in section. The second end 24 of the second half 20 also has a guide 42 formed thereon and a limit 44 formed thereon below the ridge 40 and guide 42.

The jaw 50 has a first distal end 52 and a second distal end 54. The first distal end 52 is pressed into the slot 36 in a direction and cannot be easily removed out in the opposite direction.

Figure 3:
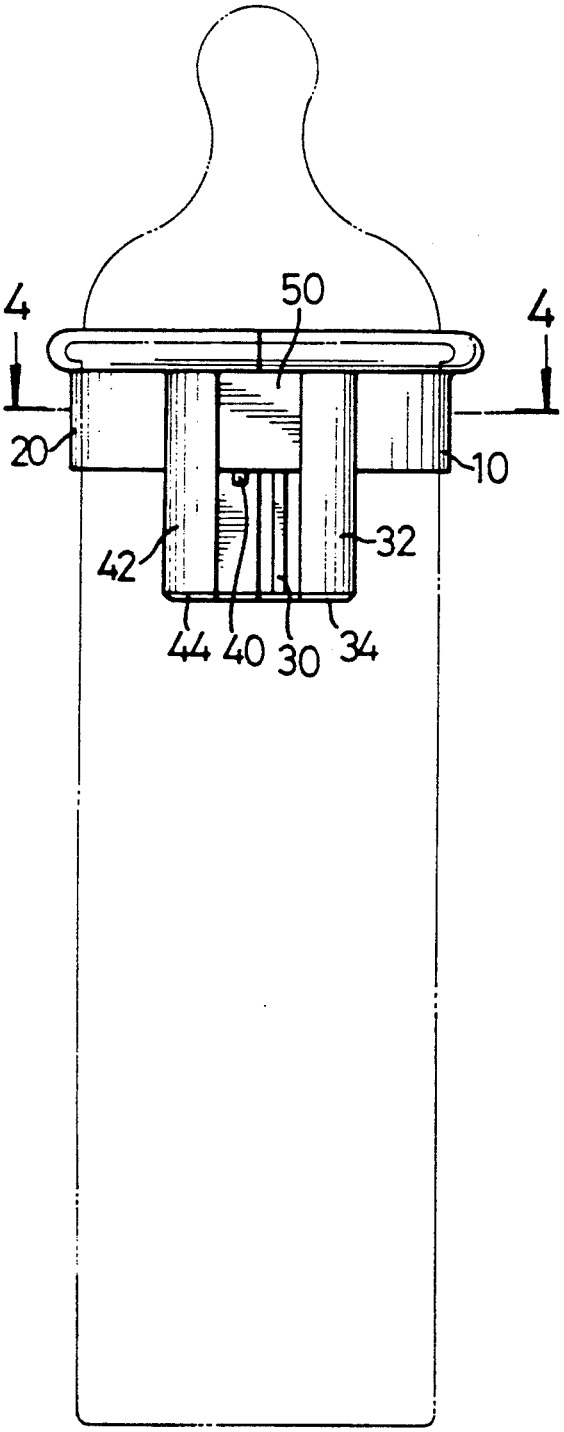
FIG. 3 is a view similar to FIG. 2, but showing the jaw in a second position relative to the ridges.
Figure 2:
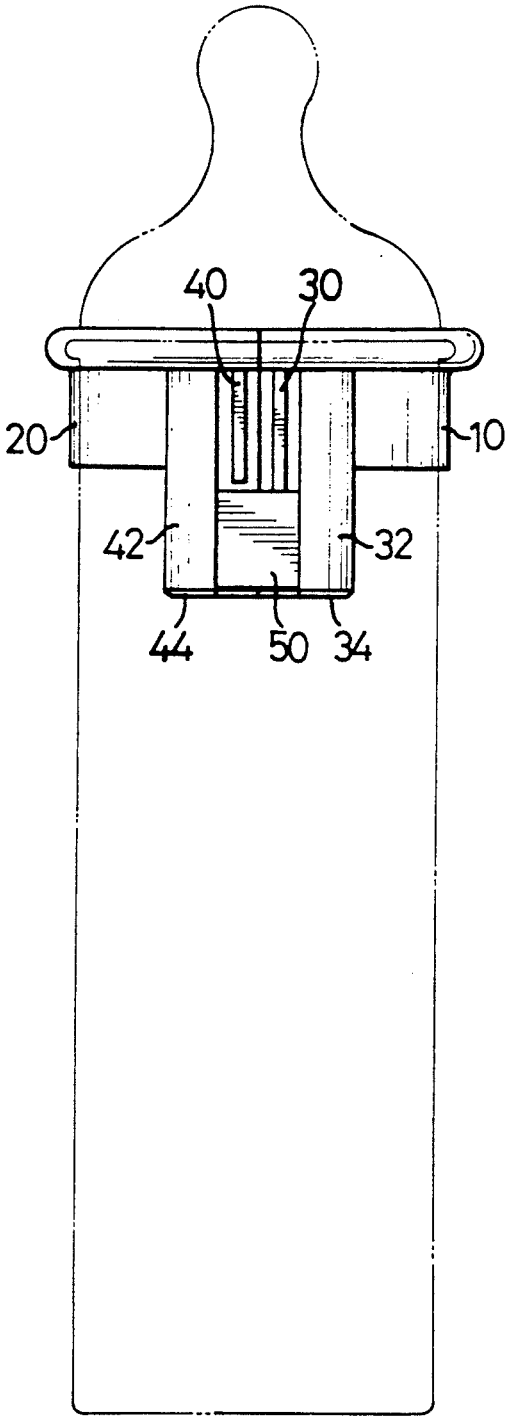
FIG. 2 is a side view of the clamp according to the present invention, showing a jaw in a first position with respect to two ridges.

In use, a nipple 70 is mounted in a top portion of an annular rigid neck (not shown). A lower portion of the rigid neck is received in the opening of a paper nursing bottle 72. The neck usually possesses a flange radially protruding therefrom so that the flange of the neck is disposed above/against an upper rim of the nursing bottle 70 when the neck is mounted in the opening of the nursing bottle 70. Then, the halves 10 and 20 are disposed about the nursing bottle 70 so that the flange of the neck is disposed between the long and short portions of the J-shaped flanges of the halves 10 and 20. The second ends of the halves 10 and 20 are disposed against each other so that the jaw 50 is disposed between the guides 32 and 42. In a first position of the jaw 50 relative to the ridges 30 and 40 as shown in FIG. 2, the distal end 52 engages with the ridge 30, but the distal end 54 does not engage with the ridge 40. Then, the jaw 50 is moved to a second position relative to the ridges 30 and 40 as shown in FIG. 3, so that the distal end 52 engages with the ridge 30 and the distal end 54 engages with the ridge 40. The halves 10 and 20 are kept from pivoting with respect to each other as the ridges 30 and 40 are restrained between the distal ends 52 and 54 of the jaw 50.

The aforementioned steps can be performed easily, even by a new user. Further, the whole process of the establishment of a bottle available for feeding can be accomplished just with only one hand of the user so that he/she is able to do some important things simultaneously, for example, embracing a crying baby.

Although the invention has been explained in relation to its preferred embodiment, it is to be understood that many other possible modifications and variations can be made without departing from the spirit and scope of the invention as hereinafter claimed.

I claim:

1. A clamp for fastening an annular rigid neck, wherein a nipple is mounted, in an opening of a paper nursing bottle, comprising:

pivotally joined first and second semi-cylindrical halves for enclosing a top portion of the nursing bottle wherein the rigid neck is mounted, each of said halves defining a first end pivotally linked to each other and a second end defining a ridge formed thereon and having a J-shaped flange formed on an upper rim thereof wherein the J-shaped flange has a short portion extending radially outward from the upper rim of each half and a long portion extending radially inwardly from the short portion; and a jaw comprising a first distal end and a second distal end for slidably engaging with the ridges for assembling said halves into a cylindrical form, wherein the second end of the first semi-cylindrical half has a relatively longer ridge extending from the underside of the J-shaped flange of the first semi-cylindrical half, while the second end of the second semi-cylindrical half has a relatively shorter ridge extending from the underside of the J-shaped flanges of the second semi-cylindrical half, such device forming two positions of the jaw relative to the ridges, so that in the first position, the jaw only engages with the longer ridge and that in the second position the jaw engages with the longer ridge and the shorter ridge for assembling the semi-cylindrical halves into a cylindrical form.

2. A clamp as claimed in claim 1, wherein each said first end of said first half and said second half comprises a knuckle, said knuckles engaging with each other.

3. A clamp as claimed in claim 2, the said knuckles each further define a hole formed therein and comprise a pin inserted in the holes formed in the engaging knuckles.

4. A clamp as claimed in claim 1, wherein the first distal end of the jaw is slidably linked to the first half of the clamp.

5. A clamp as claimed in claim 1, wherein the second end of the first semi-cylindrical half comprises a guide formed thereon and a limit formed thereon below the longer ridge and the guide, and said guide cooperates with the longer ridge so as to define a slot wherein the first distal end of the jaw is slidably mounted, and when view vertically the slot has a substantially dovetailed section and the first distal end of the jaw has a slightly smaller but otherwise identical shape to the slot so that the first distal end of the jaw cannot be removed out of the slot, and said limit can prevent the jaw from sliding out of the first semi-cylindrical half.

6. A clamp as claimed in claim 1, wherein the second end of the second semi-cylindrical half further comprises a guide formed thereon, and said guide cooperates with the shorter ridge so as to further facilitate the second distal end of the jaw engaging tightly with the shorter ridge, and said limit can further prevent the second distal end of the jaw from sliding out of the second semi-cylindrical half.

7. A clamp as claimed in claim 1, wherein the second end of the second semi-cylindrical half further comprises a limit formed thereon below the longer ridge and the guide.

* * * * *